US007179047B2

(12) United States Patent
Cooper

(10) Patent No.: US 7,179,047 B2
(45) Date of Patent: Feb. 20, 2007

(54) VANE APPARATUS FOR A GAS TURBINE ENGINE

(75) Inventor: Brian G Cooper, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/919,391

(22) Filed: Aug. 17, 2004

(65) Prior Publication Data

US 2005/0058546 A1 Mar. 17, 2005

(30) Foreign Application Priority Data

Aug. 23, 2003 (GB) ..... 0319877.7

(51) Int. Cl.
*F01D 9/06* (2006.01)

(52) U.S. Cl. ..... 415/115; 416/96 A

(58) Field of Classification Search ..... 415/115–116; 416/96 R, 96 A, 97 R
See application file for complete search history.

(56) References Cited

U.S. PATENT DOCUMENTS 4,025,226 A * 5/1977 Hovan ..... 415/115
6,142,734 A * 11/2000 Lee ..... 416/97 R
6,544,001 B2 * 4/2003 Dailey ..... 416/97 R
2003/0068222 A1 * 4/2003 Cunha et al. ..... 415/115

FOREIGN PATENT DOCUMENTS

| | | |
|---|---|---|
| EP | 0 034 961 A | 9/1981 |
| GB | 1 467 483 SP | 3/1977 |
| GB | 2 189 553 A | 10/1987 |
| SU | 1 287 678 AB | 2/1997 |

* cited by examiner

*Primary Examiner*—Christopher Verdier
(74) *Attorney, Agent, or Firm*—W. Warren Taltavull; Manelli Denison & Selter PLLC

(57) ABSTRACT

A vane assembly for a gas turbine engine, the vane assembly comprising an aerodynamic main body across which gas can flow in streamlines, the main body defining a chamber and a plurality of cooling apertures extending through the main body, the cooling apertures being arranged in a plurality of arrays, wherein the vane assembly is arrangeable so that each array is generally parallel to the streamlines, and the vane assembly further including a baffle arrangement provided in the chamber the baffle arrangement having a gas deflection surface which extends across a plurality of the arrays.

15 Claims, 3 Drawing Sheets

VANE APPARATUS FOR A GAS TURBINE ENGINE

FIELD OF THE INVENTION

This invention relates to vane apparatus for a gas turbine engine. More particularly, but not exclusively, the invention relates to nozzle guide vanes for turbines in gas turbine engines.

BACKGROUND OF THE INVENTION

The high pressure turbine of a gas turbine engine incorporates nozzle guide vanes to guide the air onto the turbine blades. In some nozzle guide vanes, compartments are provided to which cooling air is fed. Usually the air is fed via the tip and the root of the vane. The cooling air exits the compartment via film cooling holes arranged in arrays extending generally parallel to the axis of the engine.

A baffle is arranged in the compartment where the two cooling flows meet. In certain conditions, the flow of air through the cooling compartment can carry debris with it which impacts on the baffle plates and can then block the cooling film holes close to the baffle. As a result, these cooling film holes can be blocked by the debris. All the film holes in the array adjacent the baffle can be blocked which can result if lack of cooling of the vane in that region is desired.

SUMMARY OF THE INVENTION

According to one aspect of this invention, there is provided a vane apparatus for a gas turbine engine, the vane apparatus comprising an aerodynamic main body across which gas can flow in streamlines, the main body defining a chamber and a plurality of cooling apertures extending through the main body, the cooling apertures being arranged in a plurality of arrays, wherein the vane assembly is arrangeable so that each array is generally parallel to the streamlines, and the vane assembly further including a baffle arrangement provided in the chamber, the baffle arrangement having a gas deflection surface which extends across a plurality of the arrays. The gas deflection surface is continuous across its entire extent.

Preferably, the baffle arrangement comprises first and second gas deflection surfaces, each extending across the plurality of the arrays. The, or each, gas deflection surface may be angled relative to the arrays. Preferably, the baffle arrangement comprises a baffle member. The baffle member may comprise a plate. The gas deflection surfaces may be parallel to each other.

The baffle arrangement may comprise support means for supporting the baffle member. The support means may comprise a support member mountable to the wall of the chamber. The chamber may be provided with holding formations to hold the baffle arrangement. The holding formations may comprise brackets to hold the support member. Preferably, the holding formations comprise three of said brackets.

The baffle member is preferably mounted on a support member. The support means may further include a bracing member extending between the support member and the baffle member.

BRIEF DESCRIPTION OF THE DRAWINGS

An embodiment of the invention will now be described by way of example only, with reference to the accompanying drawings, in which.

DETAILED DESCRIPTION OF THE INVENTION

Figure 1:
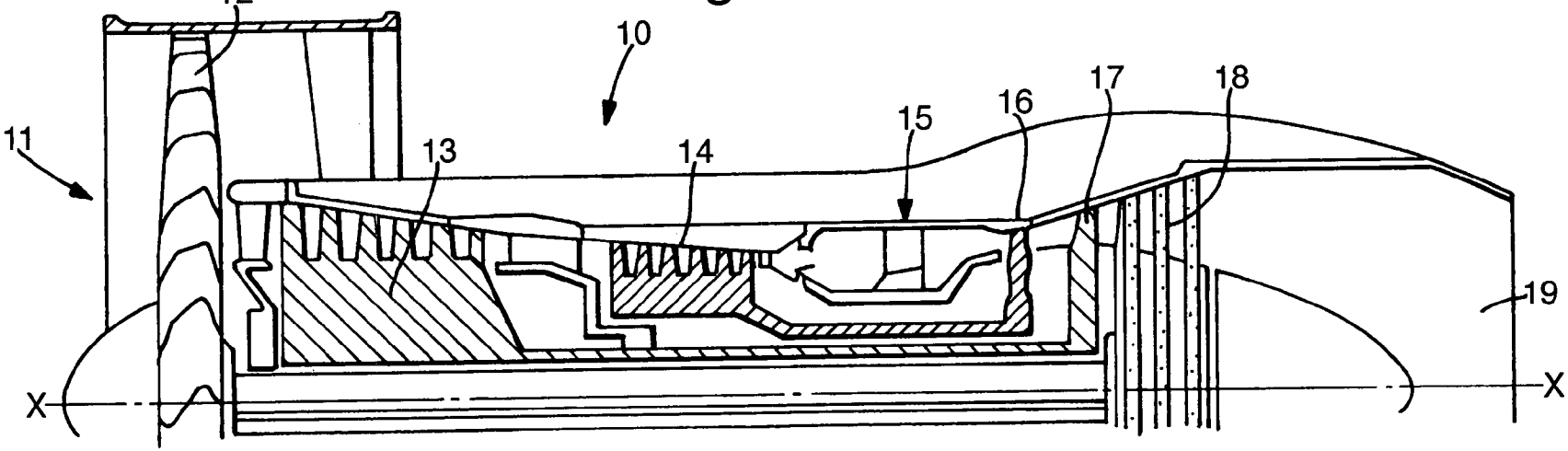
FIG. 1 is a cross sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

Figure 2:
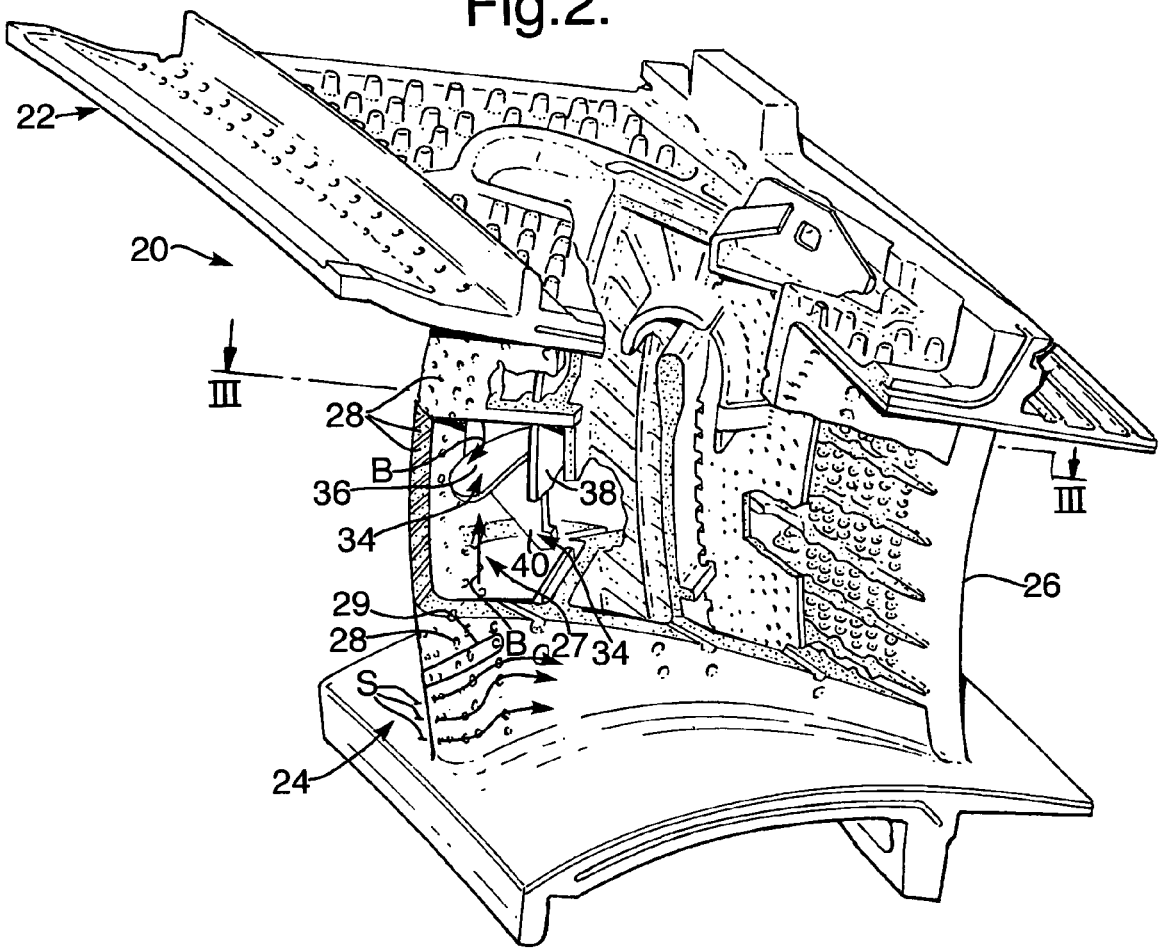
FIG. 2 is a part sectional view of a nozzle guide vane.

Referring to FIG. 2, there is shown a vane apparatus in the form of a nozzle guide vane 20 of the high pressure turbine 16 of the gas turbine engine 10 shown in FIG. 1. The nozzle guide vane 20 comprises a radially outer casing member 22, and a radially inner casing member 24, and an aerodynamically configured main body 26 extending between the inner and outer casing members 22, 24 has from the combustor 15 flows in streamlines around the main body 26, for example as shown by the arrows marked S in FIG. 2.

The main body 26 defines a chamber 27 at the leading edge region of the main body 26. The chamber 27 extends from the outer member 22 to the inner casing member 24 through which cooling air can flow, as described below. The main body defines a plurality of film cooling apertures 28, each of which extend from the outside of the main body 26 to the chamber 27. The cooling apertures are arranged in a plurality of substantially parallel arrays 29. The main body 26 is arranged so that the arrays 29 of the cooling apertures 28 extend generally parallel with the streamlines 5 of the gas across the main body 26. It will be appreciated that in most embodiments the arrays 29 of the cooling apertures 28 extend from the leading edge of the main body 26 to the trailing edge.

The chamber 27 comprises a radially outer inlet aperture 30 and a radially inner inlet aperture 32. The inlet apertures 30, 32 allow the cooling gas as shown by the arrows A and B for example from the high pressure compressor 14, to enter the chamber 27.

A baffle arrangement 34 is provided within the chamber 27 and comprises a baffle plate 36, a support plate 38 to support the baffle plate 36 and a bracing plate 40 to brace the baffle plate 36 to the support plate 38.

Figure 4:
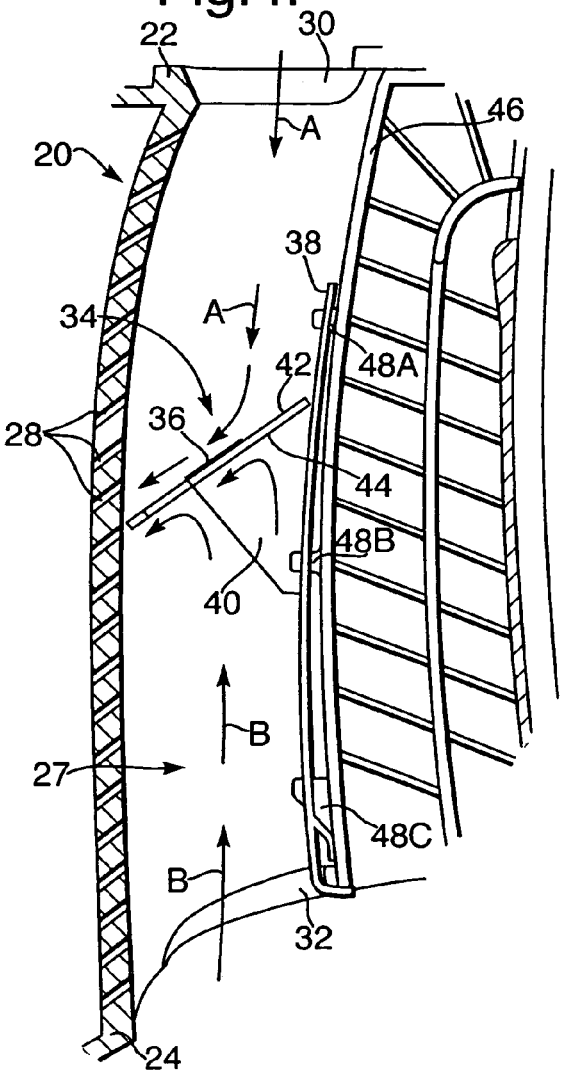
FIG. 4 is a view along the lines IV—IV in FIG. 3.

As can be seen particularly from FIG. 4 the baffle plate 36 has first and second opposite gas deflection surfaces 42, 44. The baffle plate 36 is angled at approximately 45° to the arrays 29 of cooling apertures 28. If one considers that each of the cooling apertures 28 represents a different array 29, it will be seen that the baffle plate 36 extends across a plurality of the arrays 29.

Figure 3:
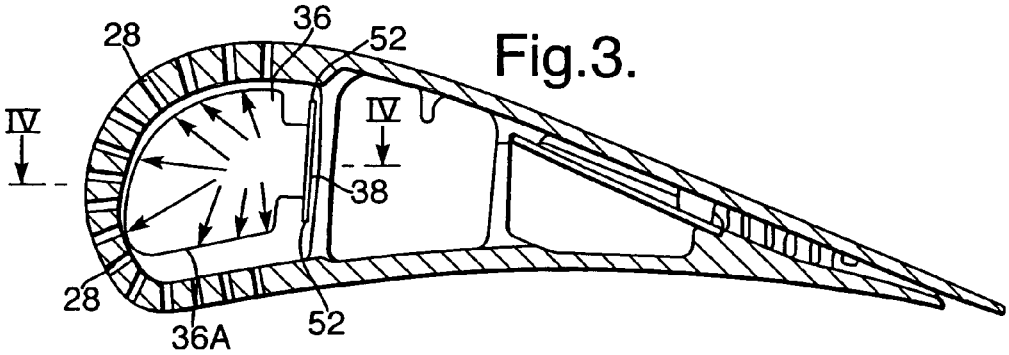
FIG. 3 is a view along the lines III—III in FIG. 2.

The baffle plate 36 is surrounded on three of its sides by cooling apertures 28. Thus, the air passing across the baffle plate 36 and exiting from it at different positions around its edge 36A (see FIG. 3), passes through cooling apertures 28 at different radial heights. This means that air passing across the baffle plate 36 passes through different arrays 29 of the cooling apertures 28.

This has the advantage in the preferred embodiment that not all the air passing from the baffle plate 36 passes through cooling apertures 28 in the same array 29. This means that where the cooling air carries the debris with it, the cooling apertures 28 in different arrays are blocked.

Figure 5A:
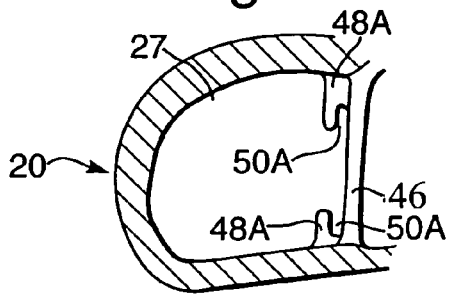
FIGS. 5A to 5C are respectively views radially inwardly of the chamber showing the lugs 48A, 48B and 48C.
Figure 5B:
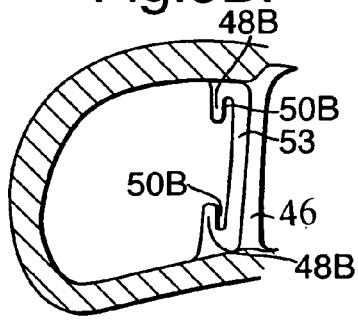
Figure 5C:
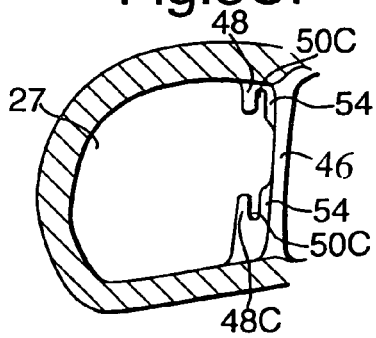

Referring to FIGS. 5A to 5C, The chamber 27 has a back wall 46 and the baffle arrangement 34 is attached to the back wall 46 of the chamber 27 via a plurality of lugs or brackets 48A, 48B and 48C arranged at different radial heights. FIG. 5A is a sectional view of the chamber 27 at the height of the radially outer lugs 48A. As can be seen, a pair of the radially outer lugs 48A are provided each defining recesses 50A between the radially outer lug 48A and the wall 46 to receive edge regions 52 of the support plate 38. Similarly, FIG. 5B shows the chamber 27 at the height of the intermediate lugs 48B, and comprises a backing portion 53 adjacent the wall 46 to define with the intermediate lugs 48B recesses 50B to receive the opposite end regions 52 of the support plate 38. FIG. 5C shows the chamber 27 at the height of the radially inner lugs 48C, and these comprise a pair of backing lugs 54 each arranged adjacent the wall 46 and define receiving apertures 50C to receive the opposite edge regions 52 of the support plate 48.

There is thus described a preferred embodiment of a simple but effective baffle plate arrangement which allows the flow of air through cooling apertures 28 without blocking the cooling apertures 28 of the part of an array in the region of the leading edge of the nozzle guide vane 20, or at the sides or flanks of the nozzle guide vane 20 around the baffle plate 36.

Various modifications can be made without departing from the scope of the invention.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A vane assembly for a gas turbine engine, the vane assembly comprising an aerodynamic main body across which gas can flow in streamlines externally of the main body, the main body defining a chamber and a plurality of cooling apertures extending through the main body, the cooling apertures being arranged in a plurality of arrays, wherein the vane assembly is arrangeable so that each array is generally parallel to the aforesaid streamlines, and the vane assembly further including a baffle arrangement provided in the chamber, the baffle arrangement having a gas deflection surface that is continuous across its entire extent and that extends across a plurality of the arrays wherein the gas deflection surface includes an edge positioned so that air passing across the gas deflection surface and exiting at different positions around said edge passes through said cooling apertures so that, in the event one or more of said cooling apertures is blocked, the air is passed through the unblocked cooling apertures.

2. A vane assembly according to claim 1, wherein the baffle arrangement comprises first and second gas deflection surfaces, each extending across the plurality of the arrays.

3. A vane assembly according to claim 2, wherein the gas deflection surfaces are parallel to each other.

4. A vane assembly according to claim 2, wherein each gas deflection surface is angled relative to the arrays.

5. A vane assembly according to claim 1, wherein, the baffle arrangement comprises a baffle plate on which first and second gas deflection surfaces are provided.

6. A vane assembly according to claim 5, wherein each gas deflection surface is angled to the arrays at an angle in the range of 10° to 80°.

7. A vane assembly according to claim 6, wherein the angle of each gas deflection surface to the arrays is in the range of 30° to 60°.

8. A vane assembly according to claims 6, wherein the angle of each gas deflection surface to the arrays, is generally 45°.

9. A vane assembly according to claim 1, wherein the baffle arrangement comprises support means for supporting the baffle arrangement.

10. A vane assembly according to claim 9, wherein the support means comprises a support member mountable to a wall of the chamber, and the chamber is provided with holding formations to hold the baffle arrangement.

11. A vane assembly according to claim 10, wherein the holding formations comprise brackets to hold the support member.

12. A vane assembly according to claim 11, wherein the holding formations define opposed recesses to receive opposite edge regions of the support member.

13. A turbine incorporating a vane assembly according to claim 1.

14. A gas turbine engine incorporating a turbine according to claim 13.

15. A vane assembly for a gas turbine engine, the vane assembly comprising an aerodynamic main body across which gas can flow in streamlines externally of the main body, the main body defining a chamber and a plurality of cooling apertures extending through the main body, the cooling apertures being arranged in a plurality of arrays, wherein the vane assembly is arrangeable so that each array is generally parallel to the aforesaid streamlines, and the vane assembly further including a baffle arrangement provided in the chamber, the baffle arrangement having a gas deflection surface which extends across a plurality of the arrays wherein the baffle arrangement comprises support means for supporting a baffle plate wherein the support means comprises a support member mountable to a wall of the chamber, and the chamber is provided with holding formations to hold the baffle arrangement, wherein said baffle plate is mounted on the support member, and the support means further includes a bracing member extending between the support member and said baffle plate.

* * * * *